US008414328B2

(12) United States Patent
Yamakoshi et al.

(10) Patent No.: US 8,414,328 B2
(45) Date of Patent: Apr. 9, 2013

(54) METHOD OF INSTALLING ANTENNA AND COAXIAL CONNECTOR

(75) Inventors: Daisuke Yamakoshi, Tokyo (JP); Tsuyoshi Nakagawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 211 days.

(21) Appl. No.: 12/961,958

(22) Filed: Dec. 7, 2010

(65) Prior Publication Data

US 2011/0136378 A1 Jun. 9, 2011

(30) Foreign Application Priority Data

Dec. 7, 2009 (JP) ..... 2009-277343

(51) Int. Cl.
*H01R 9/05* (2006.01)

(52) U.S. Cl.
USPC ..... 439/582; 439/188; 439/944

(58) Field of Classification Search ..... 439/582, 439/854, 855, 902, 188, 63, 944
See application file for complete search history.

(56) References Cited

U.S. PATENT DOCUMENTS 4,911,660 A * 3/1990 Alf et al. ..... 439/585
5,412,393 A * 5/1995 Wiggenhorn ..... 343/702
5,772,470 A * 6/1998 Togashi ..... 439/582
5,944,546 A * 8/1999 Miyake et al. ..... 439/188
6,118,408 A * 9/2000 Yang et al. ..... 343/702
6,648,653 B2 * 11/2003 Huang et al. ..... 439/63
7,131,846 B2 * 11/2006 Barlerin et al. ..... 439/63
7,351,067 B2 * 4/2008 Chen et al. ..... 439/63
2009/0040117 A1 * 2/2009 Miyaura et al. ..... 343/702

FOREIGN PATENT DOCUMENTS

JP 2001-176612 A 6/2001
JP 2003-123915 A 4/2003

* cited by examiner

*Primary Examiner* — Hae Moon Hyeon
(74) *Attorney, Agent, or Firm* — Kubotera & Associates, LLC

(57) ABSTRACT

A coaxial connector to be attached to a coaxial change-over switch includes an insulated connector housing; an outer connector conductor provided outside the insulated connector housing and capable of connecting to an outer conductor of a coaxial cable; and a contact provided in the insulated connector housing to be movable for connecting to a center conductor of the coaxial cable. The contact has a first portion including a distal end portion and a second portion connected to the first portion via a bent section. The contact is mounted on a mounting section of the insulated connector housing, and is supported in a cantilever state at the second portion. The distal end portion is elastically displaced in a direction opposite to an attaching direction of the coaxial change-over switch when the distal end portion contacts with the coaxial change-over switch.

13 Claims, 10 Drawing Sheets

METHOD OF INSTALLING ANTENNA AND COAXIAL CONNECTOR

BACKGROUND TECHNOLOGY AND RELATED TECHNOLOGY

The present invention relates to a method of installing an antenna of a wireless module, and a coaxial connector to be used in the method of installing the antenna.

When a wireless module equipped with a built-in antenna is installed at one position inside a casing of a device in which the wireless module is to be installed, there is no problem if the built-in antenna can exhibit desired antenna properties at the one position. In this case, it is not necessary to provide an external antenna with a relatively high manufacturing cost and a large number of design processes. Accordingly, the manufacturing cost can be less expensive and the design processes are less.

On the other hand, when it is difficult to use the wireless module equipped with the built-in antenna, or even when the wireless module equipped with the built-in antenna is installed at one position inside a casing, but the built-in antenna cannot exhibit desired antenna properties, or when it is difficult to install the wireless module at such one position, it is necessary to install the wireless module using an external antenna disposed inside the casing.

If it is clear whether the wireless module equipped with the built-in antenna can be used or the wireless module that uses the external antenna should be used in advance, there is no problem. However, if it is not clear which wireless module should be used, it is necessary to install the wireless module using the external antenna.

After the wireless module using the external antenna is installed, if it is found to be possible to use the wireless module equipped with the built-in antenna, the external antenna, which is expensive and requires more design manhours, will be unnecessarily used, thereby increasing the cost and lowering work efficiency. Patent Reference 1 has disclosed such conventional techniques.

Patent Reference 1: Japanese Patent Publication No. 2003-123915

A conventional coaxial connector is used in a pair with a conventional coaxial change-over switch. The conventional coaxial change-over switch has been widely used in portable communication devices such as a mobile phone for inspecting high-frequency circuits. FIG. 13 is a view showing a conventional coaxial change-over switch 121. The coaxial change-over switch 121 is similar to one disclosed in Patent Reference 2.

Patent Reference 2: Japanese Patent Publication No. 2001-176612

The coaxial change-over switch 121 includes a stationary terminal 124 and a movable terminal 125, which are disposed in an insulated housing 122 and can contact with and separate from each other. A center conductor 129 is supported on an insulated housing 127 of the coaxial connector 126. When the center conductor 129 is moved downward through an insertion hole 135 formed in the insulated housing 122, the stationary terminal 124 stays stationary, and only the movable terminal 125 moves to a position indicated with a hidden line, so that the stationary terminal 124 is disconnected from the movable terminal 125.

When the movable terminal 125 is disconnected from the stationary terminal 124, the center conductor 129 of the coaxial connector 126 is in a state of contacting only with the movable terminal 125. As a result, it is possible to switch a signal circuit between the movable terminal 125 and the stationary terminal 124 to another signal circuit between the movable terminal 125 and the center conductor 129. Here, the change-over operation like this has been used to inspect high-frequency performance of a device equipped with a high-frequency circuit such as a mobile phone.

Conventionally, the coaxial change-over switch 121 has been used solely for inspection and only useful for inspection. More specifically, the coaxial change-over switch 121 has been used only upon inspection of a device after production and usually used only once, and therefore it has not been effectively used. In addition, an outer conductor 128 of the coaxial connector 126 is simply designed so as to be able to engage the lower end section 133 with an annular groove 132 of the coaxial change-over switch 121. Further, the coaxial connector 126 extends in the fitting direction. Therefore, the coaxial connector 126 is not structurally suitable to constantly connect between the coaxial connector 126 and the coaxial change-over switch 121.

In order to solve the above-described problems in the conventional techniques, an object of the present invention is to provide a method of installing an antenna. In the present invention, even when it is not clear whether a wireless module with a built-in antenna should be used or a wireless module using an external antenna should be used, it is possible to select one of the built-in antenna and the external antenna to a situation, and to freely switch between the built-in antenna and the external antenna. In addition, another object of the present invention is to provide a coaxial connector to be used in the method installing the antenna.

A further object of the present invention is to provide a coaxial connector capable of constantly connecting with a coaxial change-over switch, so that the coaxial change-over switch can be effectively used.

Further objects and advantages of the invention will be apparent from the following description of the invention.

SUMMARY OF THE INVENTION

In order to attain the objects described above, according to a first aspect of the present invention, a coaxial connector is to be attached to a coaxial change-over switch. The coaxial connector is a right-angle type connector, and includes an insulated connector housing; an outer connector conductor provided outside the insulated connector housing and capable of connecting to an outer conductor of a coaxial cable; and a contact provided in the insulated connector housing to be movable and capable of connecting to a center conductor of the coaxial cable.

In the first aspect of the present invention, the contact is formed in a substantially L character shape, and includes a first portion including an distal end portion of the contact and a second portion connected to the first portion via a bent section and extending in a direction substantially perpendicular to the first portion. The contact is mounted on a mounting section of the insulated connector housing at the second portion thereof. Further, the contact is supported in a cantilever state at a connection side of the coaxial cable in the second portion of the contact. The distal end portion of the contact is configured to be elastically displaced in a direction opposite to an attaching direction of the coaxial change-over switch and the coaxial connector when the distal end portion of the contact contacts with the coaxial change-over switch.

According to a second aspect of the present invention, in the coaxial connector described above, a space may be provided inside the insulated connector housing in order to prevent the second portion of the contact from hitting the insulated connector housing when the distal end portion of the contact and a proximity thereof are accommodated into the coaxial connector when the distal end portion of the contact contacts with the coaxial change-over switch and the first portion of the contact is pushed inside the insulated connector housing in the direction opposite to the attaching direction.

According to a third aspect of the present invention, in the coaxial connector described above, a thin section may be provided on a part of a wall of the insulated connector housing to form the space.

According to a fourth aspect of the present invention, in the coaxial connector described above, the insulated connector housing may include a main body with the contact disposed thereon and a bent section having a basal side supported in a cantilever state on the main body and an end part curved towards the main body for covering the second portion of the contact disposed on the main body.

According to a fifth aspect of the present invention, in the coaxial connector described above, the center conductor may be tightly fitted between the second portion of the contact disposed on the main body and the bent section.

According to a sixth aspect of the present invention, in the coaxial connector described above, the center conductor of the coaxial cable may be disposed on a wide section formed on the second portion of the contact and having a large width in a direction intersecting with a disposing direction of the coaxial cable.

According to a seventh aspect of the present invention, in the coaxial connector described above, the outer conductor covering the wide section may have a notched portion in the intersecting direction.

According to an eighth aspect of the present invention, in the coaxial connector described above, a sloped section or a step section may be provided between the thin section and a medium-thickness section having a thickness greater than that of the thin section.

According to a ninth aspect of the present invention, in the coaxial connector described above, a thinner section may be provided in a part of the bent section, so that the center conductor of the coaxial cable is separated from the outer connector conductor. The thinner section has a thickness smaller than that of the thick section tightly contacting with the center conductor of the coaxial cable and a width smaller than that of the wide section.

According to a tenth aspect of the present invention, in the coaxial connector described above, the distal end portion of the contact may have a function of wiping the coaxial change-over switch when the distal end portion of the contact contacts with the coaxial change-over switch.

According to an eleventh aspect of the present invention, a coaxial connector is to be attached to a coaxial change-over switch. The coaxial connector is a right-angle type connector, and includes an insulated connector housing; an outer connector conductor provided outside the insulated connector housing; and a contact provided in the insulated connector housing to be movable.

In the eleventh aspect of the present invention, the insulated connector housing has a main body with the contact disposed thereon, and a bent section supported on the main body at a basal side thereof and having an end curved toward the main body for covering a second portion of the contact disposed on the main body. The bent section has a thin section at a basal side thereof and a thick section at an end side thereof. The outer connector conductor has an outer bent section curved toward the bent section for covering outside of the bent section.

In the eleventh aspect of the present invention, the contact is formed in a substantially L character shape, and includes a first portion including an distal end portion of the contact and a second portion connected to the first portion via a bent section and extending in a direction substantially perpendicular to the first portion. The contact is mounted on a mounting section of the insulated connector housing at the second portion thereof. Further, the contact is supported in a cantilever state at an end of the second portion of the contact. The distal end portion of the contact is configured to be elastically displaced in a direction opposite to an attaching direction of the coaxial change-over switch and the coaxial connector when the distal end portion of the contact contacts with the coaxial change-over switch.

According to a twelfth aspect of the present invention, a method of installing an antenna uses a wireless module with a built-in antenna. The wireless module is capable of connecting to an external antenna through a coaxial cable. A coaxial connector and a coaxial change-over switch are used to connect the coaxial cable to the external antenna.

In the twelfth aspect of the present invention, the coaxial connector is a right-angle type connector, and includes an insulated connector housing; an outer connector conductor provided outside the insulated connector housing and capable of connecting to an outer conductor of a coaxial cable; and a contact provided in the insulated connector housing to be movable and capable of connecting to a center conductor of the coaxial cable. The contact is configured so that an end thereof protrudes outside of the insulated connector housing before the coaxial connector is attached to the coaxial change-over switch.

In the twelfth aspect of the present invention, the coaxial change-over switch includes an insulated switch housing having an insertion hole for receiving the contact of the coaxial connector; an outer switch conductor provided outside the insulated switch housing; and a first contact arm and a second contact arm provided inside the insulated switch housing for contacting to and separating from each other.

In the twelfth aspect of the present invention, before the coaxial connector is attached to the coaxial change-over switch, the coaxial change-over switch forms a signal circuit with the built-in antenna. When the coaxial connector is attached to the coaxial change-over switch, the outer switch conductor of the coaxial change-over switch detachably contacts with the outer connector conductor of the coaxial connector. Further, the distal end portion of the contact inserted through the insertion hole of the insulated change-over switch contacts with the first contact arm, so that the first contact arm is separated from the second contact arm. Accordingly, the first contact arm formed another signal circuit with the coaxial connector.

In the twelfth aspect of the present invention, when the distal end portion of the contact protruding outside the insulated connector housing contacts with the first contact arm, the distal end portion of the contact is elastically displaced in a direction opposite the attaching direction of the coaxial change-over switch and the coaxial connector.

In the twelfth aspect of the present invention, when the wireless module is disposed in a casing of a device at a specific position, and the built-in antenna provided in the wireless antenna does not properly work, the coaxial connector is attached to the coaxial change-over switch connected to the built-in antenna. Accordingly, through the coaxial cable connected to the coaxial connector, the wireless module is connected to the external antenna.

In the present invention, with the antenna installation method, it is possible to select or switch between the built-in antenna of the wireless module and the external antenna according to the position of the wireless module. In addition, the coaxial connector can be used in the antenna installation method.

DETAILED DESCRIPTION OF THE PREFERRED EMBODIMENTS

Hereunder, embodiments of the invention will be described with reference to the accompanying drawings.

First Embodiment

Figure 1:
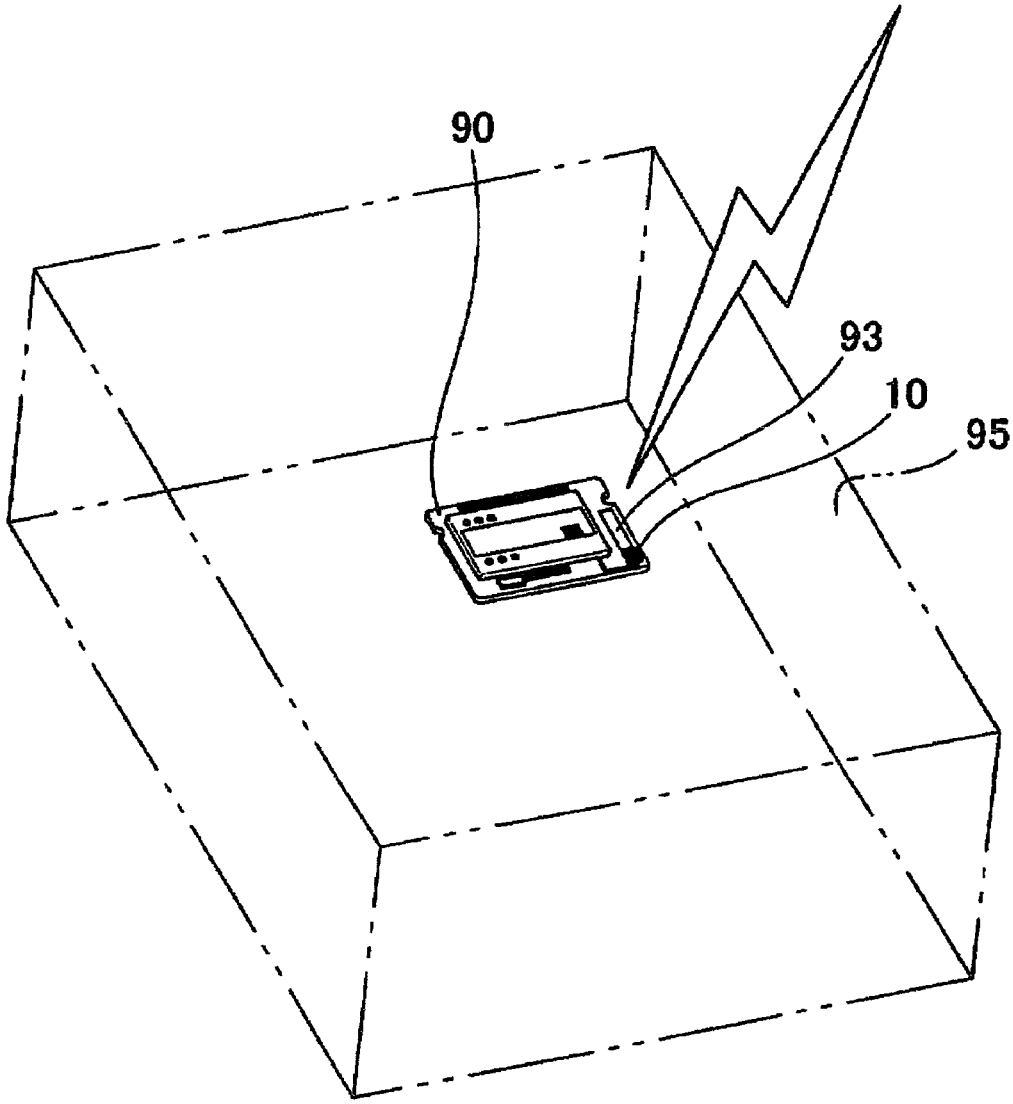
FIG. 1 is a perspective view showing a wireless module disposed in a device for explaining a method of installing an antenna according to an embodiment of the present invention.
Figure 2A:
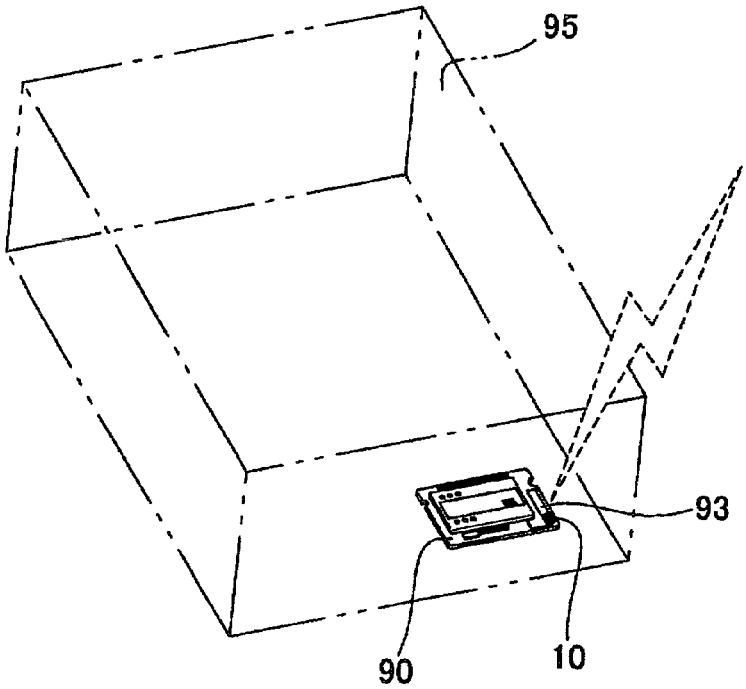
FIGS. 2(*a*) and 2(*b*) are perspective views showing the wireless module disposed in the device for explaining the method of installing the antenna according to the embodiment of the present invention.
Figure 2B:
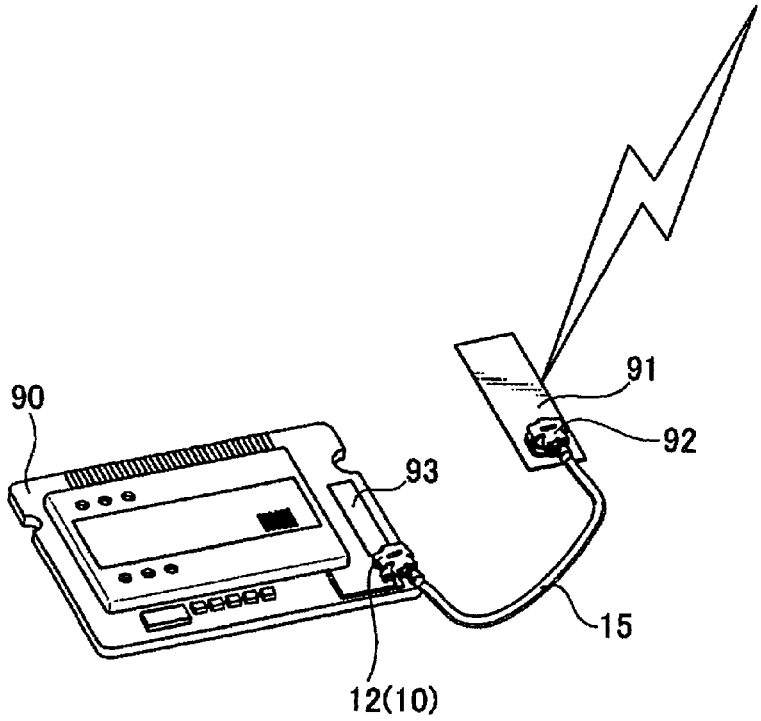

Referring to FIGS. 1 and 2, an antenna installation method of the invention will be described. FIG. 1 is a perspective view of a state where a wireless module 90 equipped with a built-in antenna 93 is disposed in one position inside a casing 95 in a device to install the wireless module 90. Here, at this position, it is assumed that the built-in antenna 93 can exhibit desired antenna characteristics; in short, the built-in antenna 93 can suitably work.

Although the perspective view of FIG. 2(*a*) is similar to FIG. 1, the wireless module 90 to install the built-in antenna 93 is disposed at a different from the above position. Here, at the different position, it is assumed that the built-in antenna 93 cannot exhibit desired antenna characteristics, in short the built-in antenna 93 cannot suitably work.

Depending on the size or shape of a device to install the wireless module 90, or for some reasons, such as relation to another module to be installed, in some cases, the wireless module 90 may have to be installed in a position where the built-in antenna 93 cannot suitably work as shown in FIG. 2(*a*), not in a position where the built-in antenna 93 can suitably work as shown in FIG. 1. In the latter case, in order to secure the antenna characteristics, it is necessary to use the external antenna 91 shown in FIG. 2(*b*) or the like, instead of the built-in antenna 93.

The external antenna 91 becomes usable only after connecting to the wireless module 90 via the coaxial cable 15. Moreover, connecting a flexural coaxial cable 15 between the wireless module 90 and the external antenna 91 so as to dispose the external antenna 91 in any suitable position, in a casing 95, it is possible to secure the desired antenna characteristics. Here, in this case, the built-in antenna 93 is in a state of "ON" before the external antenna 91 is connected to the wireless module 90, but once they become connected, the signal circuit is automatically switched, and the built-in antenna becomes turned into the "OFF" state, and in turn, the external antenna 91 becomes to the "ON" state.

Here, the connection between the coaxial cable 15 and the wireless module 90 is made using the coaxial connector 12 provided on the coaxial cable 15 side and a coaxial change-over switch (coaxial connector with a switch) 10 provided on the wireless module 90 side. Especially, as for the coaxial change-over switch 10, it is possible to use the conventional coaxial change-over switch 10 as is, which has been generally widely used for inspection of high-frequency circuits and was described above referring to FIG. 13.

In further detail, in the invention, it is possible to use the coaxial change-over switch 10, which has been used only for inspection, as a connector to connect between the wireless module 90 and the coaxial cable 15, or even for electrical connection between the wireless module 90 and the external antenna 91 connected to the coaxial cable 15 as well as for inspection, by constantly connecting with the coaxial connector 12 of the invention so as to be freely attached thereto/detached therefrom.

By using the coaxial change-over switch 10 in combination as a connector, it is not necessary to additionally provide a connector, and it is possible to effectively use the coaxial change-over switch 10. In addition, even if the built-in antenna 93 was originally intended to use, but desired gain was not obtained by the built-in antenna 93 for some reasons, it is possible to easily switch the built-in antenna 93 to the external antenna 91 keeping the circuit design of the wireless module 90 as is. In other words, according to the invention, it is possible to use the wireless module 90 with the same design for two methods, one with built-in antenna 93 and the other with external antenna 91.

With the aforementioned configuration, according to the invention, it is possible to always secure antenna characteristics disposing the external antenna 91 connected to the coaxial cable 15 at any position of the casing where the external antenna 91 can suitably work, by attaching the coaxial connector 12 to the coaxial change-over switch 10 connected to the built-in antenna 93 and further using the coaxial cable 15 connected to the coaxial connector 12.

Next, a structure of the coaxial connector 12 used in the above-described method will be described.

Figure 3:
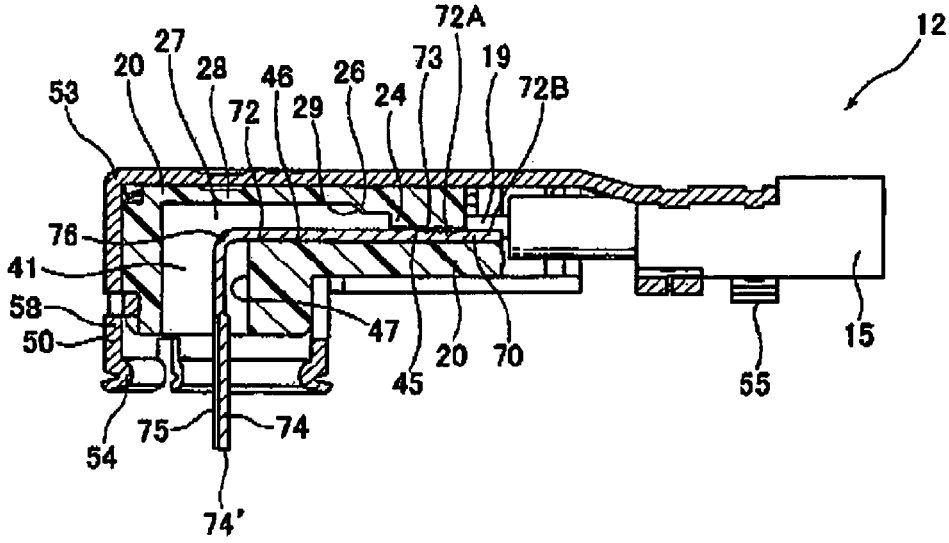
FIG. 3 is a longitudinal sectional view showing a coaxial connector in an assembled state according to the embodiment of the present invention.
Figure 4:
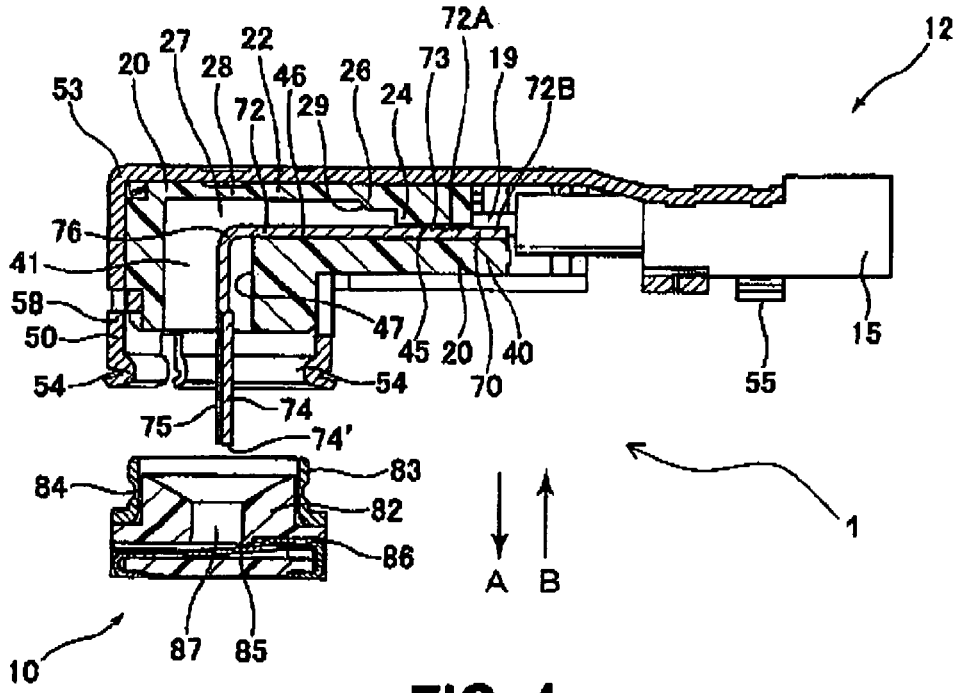
FIG. 4 is a sectional view showing a coaxial change-over switch and the coaxial connector according to the embodiment of the present invention.

FIG. 3 is a longitudinal sectional view of the coaxial connector 12 after assembling; FIG. 4 is a sectional view of the coaxial change-over switch 10 shown with the coaxial connector 12 of FIG. 3; and FIG. 5 is a sectional view of the coaxial change-over switch 10 after the coaxial connector 12 is attached thereto.

Figure 5:
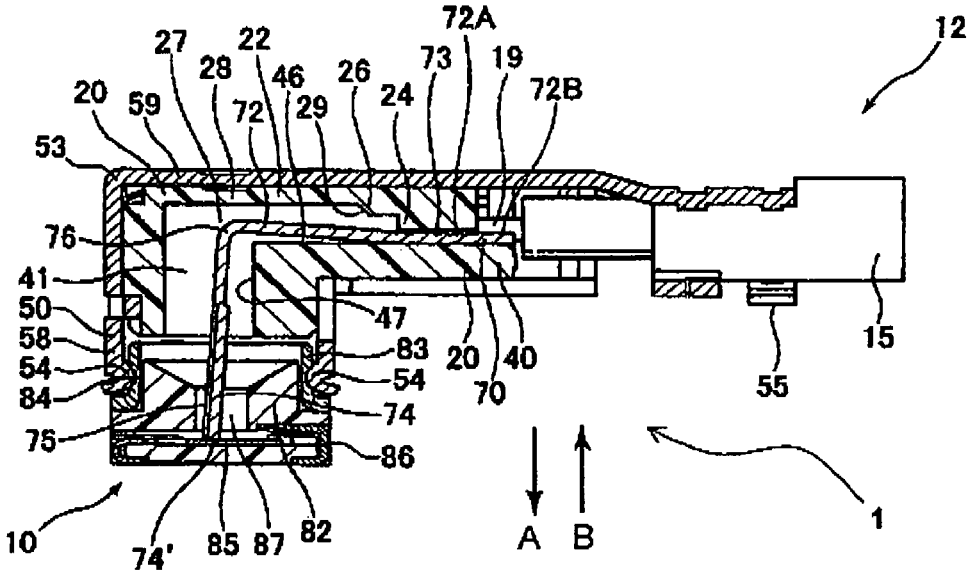
FIG. 5 is a sectional view showing the coaxial change-over switch and the coaxial connector after the coaxial connector is attached to the coaxial change-over switch according to the embodiment of the present invention.
Figure 6:
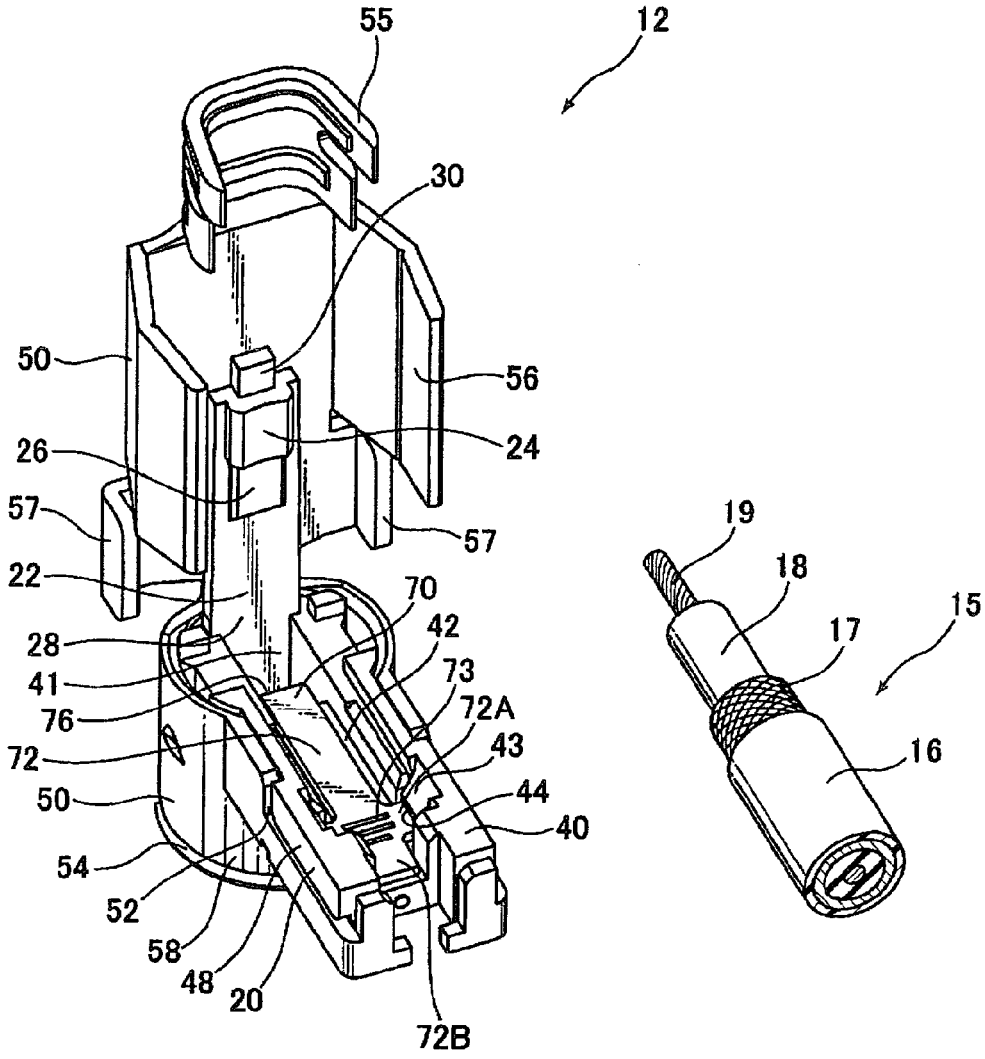
FIG. 6 is a perspective view showing the coaxial connector before a coaxial cable is attached to the coaxial connector according to the embodiment of the present invention.
Figure 7:
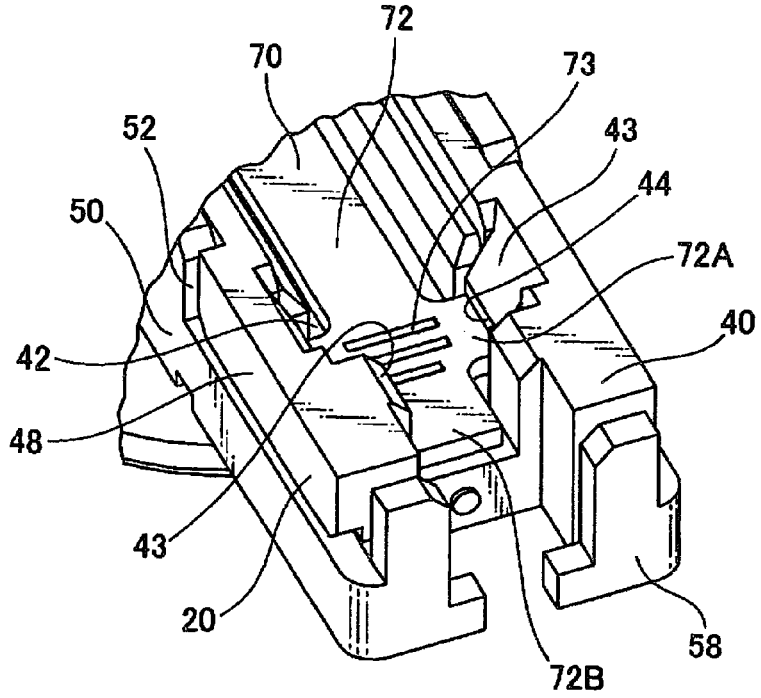
FIG. 7 is a partially enlarged view showing the coaxial connector according to the embodiment of the present invention.
Figure 8:
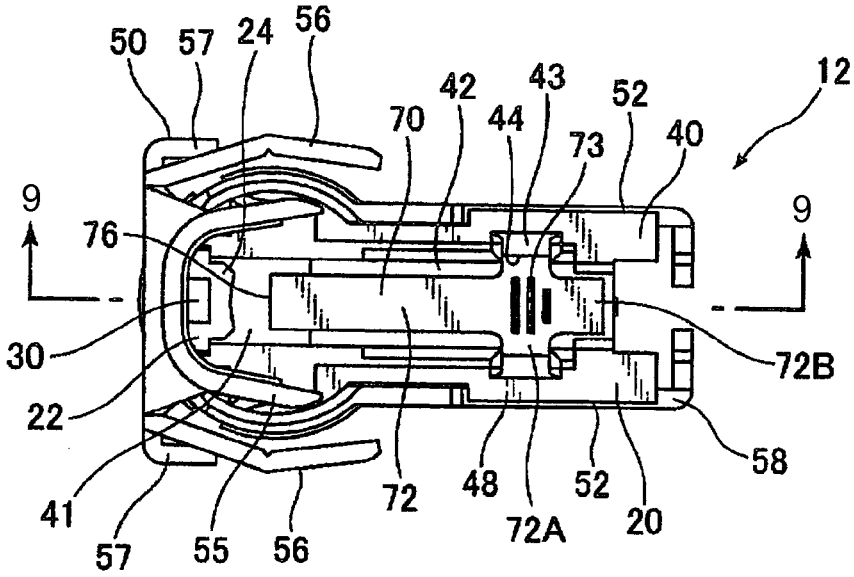
FIG. 8 is a plan view showing the coaxial connector before the coaxial cable is attached to the coaxial connector according to the embodiment of the present invention.
Figure 9:
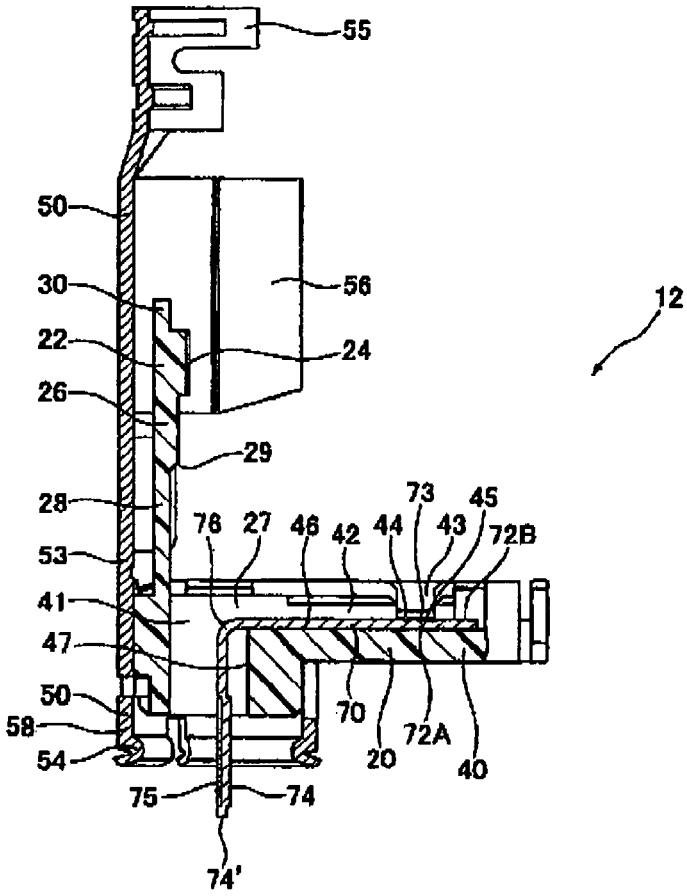
FIG. 9 is a sectional view showing the coaxial connector taken along a line 9-9 in FIG. 8 according to the embodiment of the present invention.

FIGS. 3 through 5 show the states after the coaxial cable 15 is attached thereto, whereas FIGS. 6 through 9 show the states of the coaxial connector 12 in the middle of assembling before attaching the coaxial connector 15. In FIG. 6 is a perspective view of a state where the coaxial cable 15 is about to be attached to the coaxial connector 12; FIG. 7 is a partial enlarged view of FIG. 6; FIG. 8 is a top view of the coaxial connector 12 in the state of FIG. 6; and FIG. 9 is a sectional view of FIG. 8 taken along a line 9-9.

Figure 13:
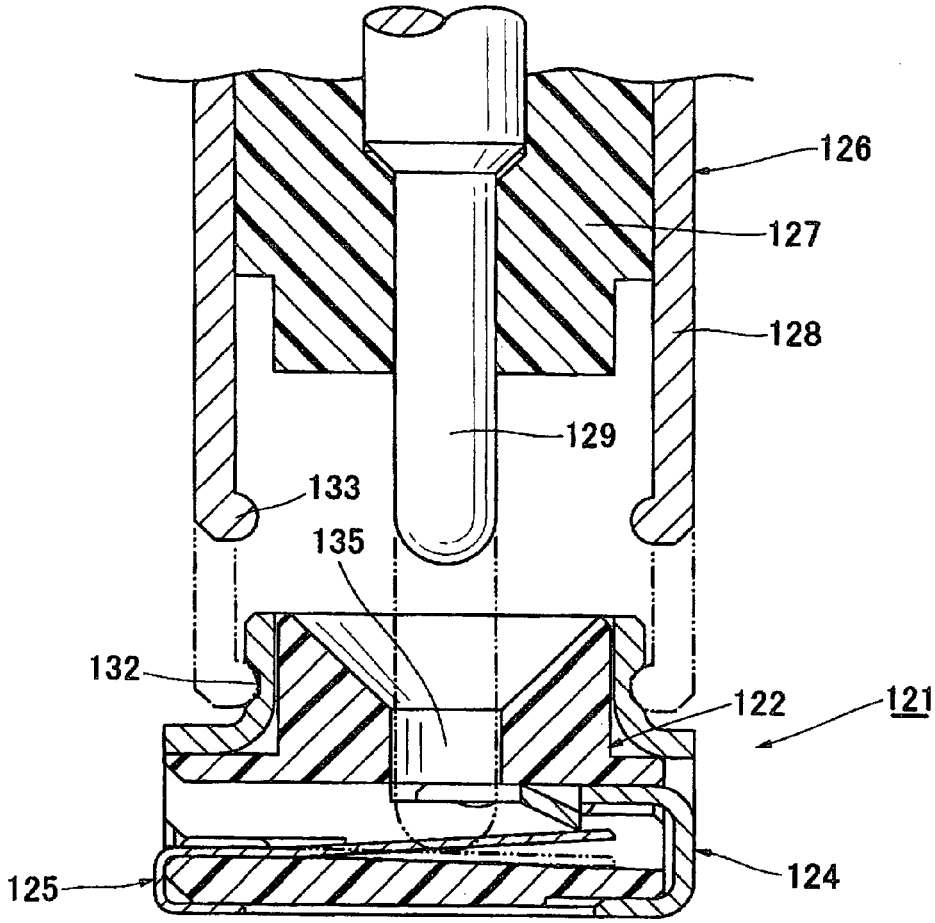
FIG. 13 PRIOR ART
FIG. 13 is a sectional view showing a conventional coaxial change-over switch.

The structure and functions of the coaxial change-over switch 10 shown only in FIGS. 4 and 5 are similar to those of a general conventional coaxial change-over switch already described with FIG. 13. The coaxial change-over switch 10 includes an insulated switch housing 82 having an insertion hole 87, which can accept a contact 70 of the coaxial connector 12 therein, as a primary component; an outer switch conductor 83 provided outside the insulated switch housing 82; and an elastic arm 85 and a stationary arm 86, which are provided inside the insulated switch housing 82 and can contact with/separate from each other.

In order to easily achieve or achieve the constant connection with the coaxial change-over switch 10, the coaxial connector 12 of the invention is formed as a so-called "right-angled (bisecting at right angle)" type connector, which is different from the conventional coaxial connector 126, which extends only in the vertical direction as shown in FIG. 13.

With the configuration, it is also possible to reduce the height of the coaxial connector 12. The coaxial connector 12 includes as its primary elements, an insulated connector housing 20, an outer connector conductor 50 provided outside the insulated connector housing 20, and a contact 70 provided in the insulated connector housing 20 while being in the movable state. Furthermore, using in combination with the coaxial change-over switch 10, the coaxial connector 12 can form a set of a coaxial device 1 (see FIGS. 4 and 5).

Figure 10:
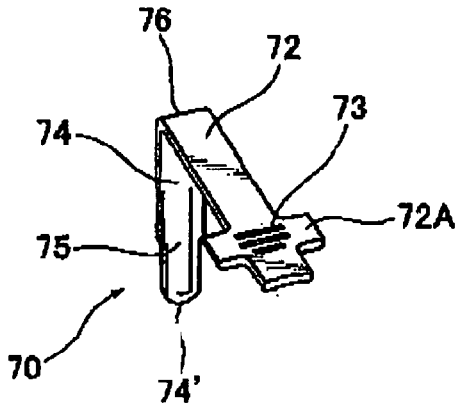
FIG. 10 is a perspective view showing a contact of the coaxial connector according to the embodiment of the present invention.

FIG. 10 shows a single-component view of the contact 70. The contact 70 is a generally L-shaped flat arm, when it is viewed from the side, and includes as its primary elements a vertical portion 74, and a horizontal portion 72, which is connected to the vertical portion 74 via the bent section 76 and extends generally at right angle in relative to the vertical portion 74. The vertical portion 74 further includes an end 74', which is inserted in the coaxial change-over switch 10 through the insertion hole 87. Here, being different from the horizontal portion 72, the vertical portion 74 is not secured to the insulated connector housing 20, and protrudes outward near the center of the flat surface as a beat 75, thereby improving the strength.

The horizontal portion 72 has a wide section 72A formed to have relatively large width in a direction intersecting with the installation direction of the coaxial cable 15. The wide section 72A is secured onto the insulated connector housing 20, and as a result, the contact 70 is supported like a cantilever as a whole. Supporting/securing the contact 70 like a cantilever at the horizontal portion 72 on the side to connect with the coaxial cable 15, i.e. near the end of the horizontal portion 72, it is possible to achieve spring length, i.e., a distance from the stationary section, the horizontal portion 72, to the movable section, i.e. the end 74' of the vertical portion 74, and thereby enhance the mobility of the contact 70 upon accommodating into the insulated connector housing 20.

The insulated connector housing 20 includes a main body 40 of a generally rectangular solid, and the bent section 22 having a thick section 24, which can be flexed in relative to the main body 40. Here, a surface of the thick section 24 is preferably formed as a concave surface, i.e. curved inward, in the width direction, i.e. in a direction intersecting with the installation direction of the coaxial cable 15. The bent section 22 is supported like a cantilever at the basal side by the main body 40, and by bending the free end side towards the main body 40, the bent section 22 is secured while pressing the contact 70 and the coaxial cable 15, which are already disposed on the main body 40.

On one side of the main body 40, which supports the bent section 22, there is provided a through hole 41 through the vertical portion 74 of the contact 70 in the vertical direction and on the side opposite the secured portion of the contact 70. In addition, on the main body 40, there is a horizontal mounting surface 46 to dispose the horizontal portion 72 of the contact 70. Disposing the contact 70 onto the horizontal mounting surface 46, it is possible to support the contact 70 in the accurate position even in the horizontal direction.

Although it is not illustrated, it is also possible to provide a vertical mounting surface, which is similar to the horizontal mounting surface 46 and can contact with the vertical portion 74 of the contact 70, in the main body 40 so as to stabilize the position of the contact 70 in the vertical direction. With the support surface like this, it is possible to securely position the bottom side and side surfaces of the contact 70 when the contact 70 receives no load. Here, the main body 40 may also have a tapered section 43, which can be used to secure the contact 70 or for other purposes.

The outer connector conductor 50 includes a cylindrical section 58 to fit to the coaxial change-over switch 10, and an outer bent section 59, which is joined to the cylindrical section 58 via the joining section 53. The outer bent section 59 is a portion that covers outside of the bent section 22 of the insulated connector housing 20, and includes cable pressure-welding section 55, insulating pressure-welding section 56, and a cover section 57. The functions of those sections will be further described later.

Referring to FIGS. 3 through 5 and 9, operation of attaching the coaxial connector 12 to the coaxial change-over switch 10 will be described. As obvious from FIGS. 3, 4, and 9 and other related parts of the specification, the end 74' and its proximity of the contact 70 greatly protrudes outside the insulated connector housing 20 before attaching the coaxial connector 12 to the coaxial change-over switch 10.

On the other hand, once the coaxial connector 12 is attached to the coaxial change-over switch 10, as shown in FIG. 5, the protruded section elastically displaced in a direction (direction B indicated with an arrow in FIGS. 4 and 5) that is opposite the attaching direction (direction A indicated with an arrow in FIGS. 4 and 5) through contact between the end 74' of the contact 70 and the elastic arm 85, and thereby a part of the contact 70 becomes held in the coaxial connector 12.

In short, the vertical portion 74 of the contact 70 is pushed into the insulated connector housing 20 in the direction of attaching the coaxial change-over switch 10 and the coaxial connector 12, or in a direction opposite the insertion direction to insert the end 74' of the contact 70 through the insertion hole 87.

In order to prevent the horizontal portion 72 of the contact 70 that is pushed from hitting the insulated connector housing 20, there is space 27 provided in the insulated connector housing 20. The space 27 may be also formed, for example, by providing a thin section 28, which is designed to have smaller thickness along the insertion direction, on a part of a wall of the insulated connector housing 20. The horizontal portion 72 of the contact 70 that is pressed and the insulated connector housing 20 can displace within range of the space 27 without hitting the insulated connector housing 20.

In case of a conventional connector of this type, the horizontal portion 72 is formed flat so as to press the whole surface of the contact, but in the invention, by providing space that can be movable region of the contact 70, the contact can move upon fitting. With the configuration, it is possible to allow stress of the contact 70, etc. to escape, thereby not to allow it to buckle and damage a component.

When the coaxial connector 12 is attached to the coaxial change-over switch 10, the outer switch conductor 83 of the coaxial change-over switch 10 and the outer connector conductor 50 of the coaxial connector 12 further contact and engage to each other, and thereby constantly connect to each other in a freely detachable/attachable manner.

In order to achieve the constant connection like this, the coaxial connector 12 has an annular protruding section 54 with an elastic action and correspondingly, the coaxial change-over switch 10 has an annular groove 84. Moreover, upon attaching, the end 74' of the contact 70 inserted through the insertion hole 87 of the insulated switch housing 82 contacts with the elastic arm 85 and separates the contacts between the elastic arm 85 and the stationary arm 86 in the vertical direction, which releases the contact with the stationary arm 86 and forms a signal circuit only between the elastic arm 85 and the coaxial connector 12.

With the switching, it is possible to selectively use the built-in antenna and the external antenna. Moreover, if it is designed to rotate around the stationary section of the contact 70, i.e. near the wide section 72A, upon contacting between the end 74' and of the contact 70 and the elastic arm 85 and slide the end 74' of the contact 70 in relative to the elastic arm 85, it is possible to remove dusts from the elastic arm 85 by its sliding movement. In other words, with the contact, there is another benefit of wiping.

Figure 11:
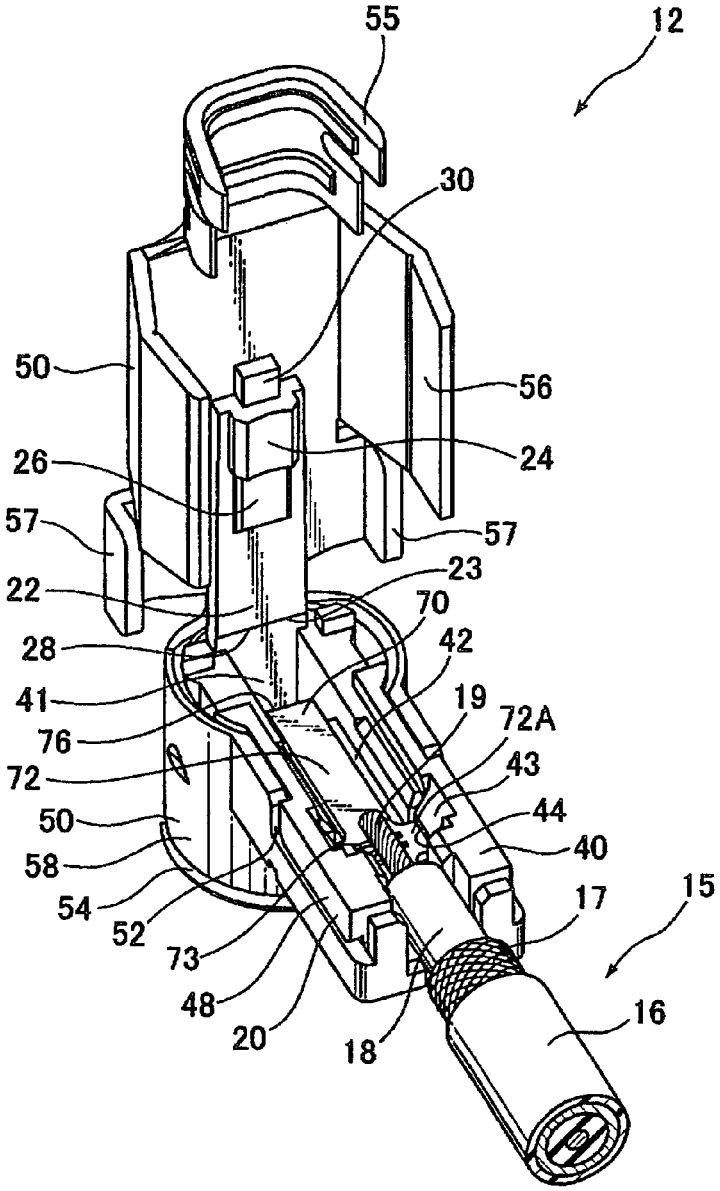
FIG. 11 is a perspective view showing the coaxial connector after the coaxial cable is disposed on a horizontal portion of the contact according to the embodiment of the present invention.
Figure 12:
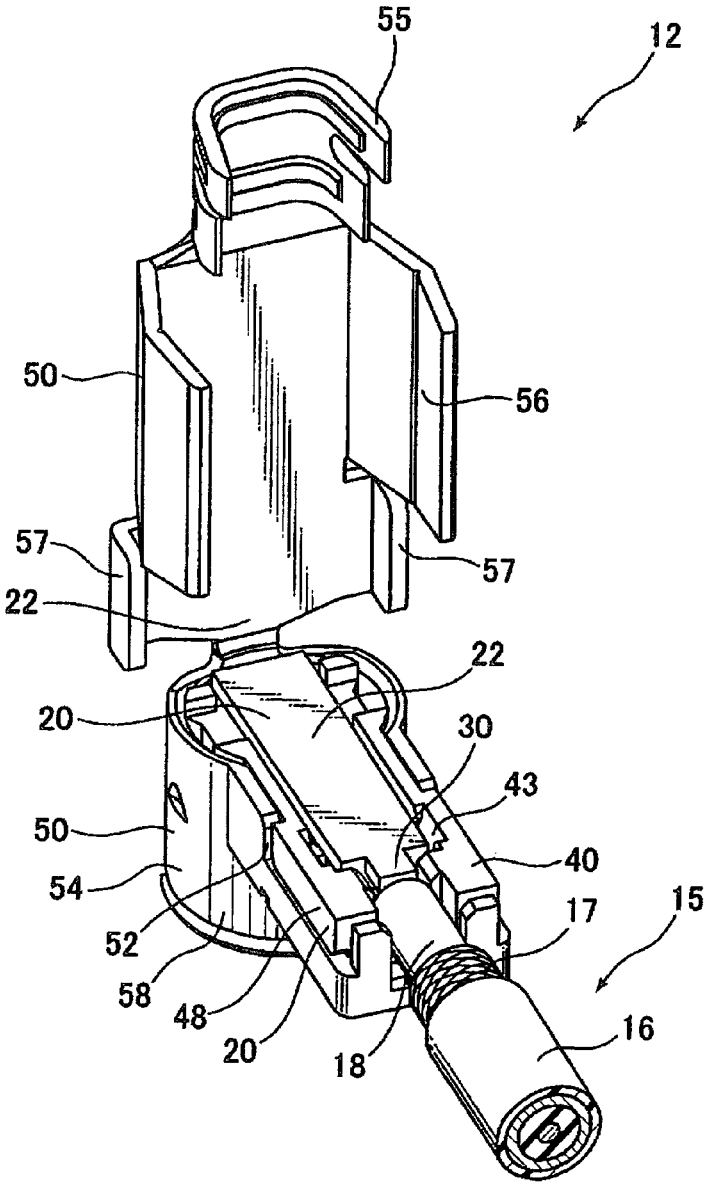
FIG. 12 is a perspective view showing the coaxial connector after the coaxial cable is tightly fitted between the horizontal portion and a bent section of the contact according to the embodiment of the present invention.

Referring to FIGS. 11 and 12 as well, assembling process of the coaxial connector 12 will be described. FIGS. 11 and 12 correspond to FIG. 6; FIG. 11 especially shows a state right after disposing the coaxial cable 15 onto the horizontal portion 72 of the contact 70, and FIG. 12 especially shows a state right after pressure-welding the coaxial cable 15, which is disposed on the horizontal portion 72, between the bent section 22 and the horizontal portion 72, by bending the end part of the bent section 22 along a fold line 23.

As shown in FIG. 12, when the end part of the bent section 22 is bent towards the main body 40, the coaxial cable 15 is pressed between the bent section 22 and the horizontal section 72 of the contact 70, the coaxial cable 15 pressure-welds to the contact 70, and the contact 70 itself is also pressed against the insulated connector housing 20. At this time, of the coaxial cable 15, the center conductor 19, which is provided at the very end including a strand, and the insulator 18, which is provided near the center conductor 19, are disposed onto the horizontal portion 72 of the contact 70.

Upon pressing the coaxial cable 15 between the bent section 22 and the horizontal portion of the contact 70, the coaxial cable 15 is press-welded between the cantilever-shaped thick section 24, which is provided in a part of the bent section 22 and has thickness decreasing along the insertion direction, and the wide section 72A of the horizontal portion 72.

Between the thick section 24 and the wide section 72A, the coaxial cable 15, mainly the center conductor 19, is disposed. Using the cantilever-shaped thick section 24, it is possible to more securely press-weld even in case of the center conductor 19 with smaller thickness in comparison with other portions, and using the wide section 72A, it is possible to reduce widening by the wide section 72A even if the center conductor 19 formed as a strand becomes widened outside by release of the strand by the pressure-welding, and thereby reduce risk of short circuit between the center conductor 19 and the side face of the outer connector conductor 50, etc.

Furthermore, if a surface of the thick section 24 is formed as a curved concave face, it is possible to more easily and securely position the center conductor 19. Here, in order to more easily engage the strand that is widened outward, for example, it may be possible to provide a beat, for example, by having a part of the wide section 72A projected downward. In the embodiment, as an example, three parallel beats 73 are provided. In addition, in order to prevent short circuit (contact) between the strand widened outside and the side face of the outer connector conductor 50, it is also possible to notch a part 52 of the outer connector conductor 50, which covers the wide section 72A, in a direction intersecting with the disposing direction of the coaxial cable 15.

In the invention, a medium-thickness section 26 is also provided, which has larger thickness than the thin section 28, but smaller thickness than the thick section 24. With the medium-thickness section 26, it is possible to enhance the strength of the thin section 28 and thereby prevent damage of the bent section 22. Between the medium-thickness section 26 and the thin section 28, it is possible to provide a sloped section 29 in the inserting direction as shown in FIGS. 3 through 5 and 9, etc, or a step-like structure (not illustrated).

Moreover, near the center conductor 19 of the coaxial cable 15, especially at the rear end side of the insulator 18, a part of the bent section 22 has a section 30, whose width is set smaller than that of the wide section 72 in the direction intersecting with the disposing direction of the coaxial cable 15 and thickness is set smaller than the thick section 24 along the inserting direction. Being configured to have smaller thickness than the thick section 24, the section 30 can electrically disconnect between the outer connector conductor 50 and the center conductor 19 without strongly pressing the coaxial cable 15 similarly to the thick section 24. In addition, with the section 30, the center conductor 19 of the coaxial cable 15 is separated from the outer connector conductor 50.

After or at the time of the state of FIG. 12, the outer bent section 59 of the outer connector conductor 50 is bent to cover an upper portion of the second portion 72 of the contact 70 by bending the towards the bent section 22, which covers the second portion 72 of the contact 70 using the joining section 53. As a result, the upper portion of the cylindrical section 58 is closed with the cover section 57 of the outer connector conductor 50.

Furthermore, the cable pressure-welding section 55 of the outer connector conductor 50 is then tightly fitted in position so as to surround the outer cover 16 of the coaxial cable 15 and the outer conductor 17, and the insulator pressure-welding section 56 is then tightly fitted in position so as to surround the insulated connector housing 20.

With the aforementioned procedures, the outer conductor 17 of the coaxial cable 15 is electrically and physically connected to the outer connector conductor 50, and the center conductor 19 of the coaxial cable 15 is electrically and physically connected to the contact 70.

In addition, the center conductor 19 of the coaxial cable 15 and its proximity, the insulator 18 are tightly fitted between the horizontal portion 72 of the contact 70 disposed on the main body 40 and the bent section 22, whereas the center conductor 19 of the coaxial cable 15 is disposed on a wide section 72A of the horizontal portion 72, which is made broad in the intersecting direction relative to the disposing direction of the coaxial cable 15, and tightly fitted between the wide section 72A and the bent section 22.

Here, the coaxial cable 15 is secured by pressure-welding, but it may be also possible to secure by other means such as soldering. The invention provides products at lost cost by securing only by a pressure-welding method.

Lastly, a method of attaching the contact 70 to the insulated connector housing 20 will be described. The contact 70 is secured while disposing the wide section 72A in gap 45 (illustrated in FIG. 9) between a lower part of the tapered section 43 of the insulated connector housing 20 and an upper part of the horizontal mounting surface 46.

Upon disposing, the wide section 72A is guided to the end 44 by the tapered section 43, rides over the end 44 to be pressed into the gap 45, and then secured therein. Therefore, it is not necessary to use adhesives or the like in the securing step. Here, as described above, instead of securing the wide section 72A, which is a part of the horizontal portion, it is also possible to secure the vertical portion 74, for example, in the front-and-back direction.

The invention may be widely applicable even if it is not clear which antenna to use between the built-in antenna and the external antenna.

The disclosure of Japanese Patent Application No. 2009-277343, filed on Dec. 7, 2009 is incorporated in the application by reference.

While the invention has been explained with reference to the specific embodiments of the invention, the explanation is illustrative and the invention is limited only by the appended claims.

What is claimed is:

1. A coaxial connector to be attached to a coaxial change-over switch, comprising:

an insulated connector housing;

an outer connector conductor provided outside the insulated connector housing and capable of connecting to an outer conductor of a coaxial cable; and a contact provided in the insulated connector housing to be movable relative to the insulated connector housing and to be connected to a center conductor of the coaxial cable, said contact being formed in a substantially L character shape having a first portion including a distal end portion and a second portion connected to the first portion via a bent section and extending in a direction substantially perpendicular to the first portion, said contact being mounted on a mounting section of the insulated connector housing at the second portion thereof, said contact being supported on a side of the coaxial cable in a cantilever state at the second portion, said distal end portion being configured to be elastically displaced in a direction opposite to an attaching direction of the coaxial change-over switch when the distal end portion contacts with the coaxial change-over switch, wherein said contact further includes a wide section formed on the second portion and having a large width in a direction intersecting with the attaching direction so that the center conductor is disposed on the wide section.

2. The coaxial connector according to claim 1, wherein said insulated connector housing includes a space for preventing the second portion from hitting the insulated connector housing when the distal end portion is accommodated into the coaxial connector and when the distal end portion contacts with the coaxial change-over switch and the first portion is pushed inside the insulated connector housing in the direction opposite to the attaching direction.

3. The coaxial connector according to claim 2, wherein said insulated connector housing includes a thin section on a wall thereof to form the space.

4. The coaxial connector according to claim 3, wherein said insulated connector housing further includes a medium-thickness section having a thickness greater than that of the thin section and a sloped section or a step section between the thin section and the medium-thickness section.

5. The coaxial connector according to claim 3, wherein said insulated connector housing further includes a thinner section on the bent section for separating the center conductor from the outer connector conductor, said thinner section having a thickness smaller than that of the thick section and a width smaller than that of the wide section.

6. The coaxial connector according to claim 1, wherein said insulated connector housing includes a main body for retaining the contact and a bent section, said bent section having a basal side supported on the main body and an end part for covering the second portion.

7. The coaxial connector according to claim 6, wherein said contact is connected to the center conductor so that the center conductor is tightly fitted between the second portion and the bent section.

8. The coaxial connector according to claim 1, wherein said outer conductor is arranged to cover the wide section and has a notched portion in the intersecting direction.

9. The coaxial connector according to claim 1, wherein said distal end portion is arranged to wipe the coaxial change-over switch when the distal end portion contacts with the coaxial change-over switch.

10. A coaxial device comprising the coaxial change-over switch and the coaxial connector according to claim 1.

11. The coaxial device according to claim 10, wherein said coaxial change-over switch includes an insulated switch housing having an insertion hole for receiving the contact; an outer switch conductor provided outside the insulated switch housing; and a first contact arm and a second contact arm provided inside the insulated switch housing for contacting to and separating from each other so that the distal end portion pushes the first contact arm away from the second contact arm when the coaxial connector is attached to the coaxial change-over switch.

12. A coaxial connector to be attached to a coaxial change-over switch, comprising:

an insulated connector housing;

an outer connector conductor provided outside the insulated connector housing; and a contact provided in the insulated connector housing to be movable, said contact being formed in a substantially L character shape, said contact including a first portion including a distal end portion thereof and a second portion connected to the first portion via a bent section and extending in a direction substantially perpendicular to the first portion, wherein said insulated connector housing has a main body for retaining the contact and a bent section supported on the main body at a basal side thereof and having an end curved toward the main body for covering the second portion, said bent section including a thin section at a basal side thereof and a thick section at an end side thereof, said outer connector conductor has an outer bent section curved toward the bent section for covering the bent section, and said contact is mounted on a mounting section of the insulated connector housing at the second portion thereof, said contact being supported, in a cantilever state at the second portion, said distal end portion being configured to be elastically displaced in a direction opposite to an attaching direction of the coaxial change-over switch when the distal end portion contacts with the coaxial change-over switch, wherein said contact further includes a wide section formed, on the second portion and having a large width in a direction intersecting with the attaching direction so that the center conductor is disposed on the wide section.

13. A method of installing an antenna of a wireless module, comprising the steps of placing the wireless module with a built-in antenna at a specific location;

checking whether the built-in antenna is properly working at the specific location; and attaching a coaxial connector to a coaxial change-over switch connected to the built-in antenna when the built-in antenna is not properly working so that the wireless module is connected to an external antenna connected to the coaxial connector through a coaxial cable and the coaxial change-over switch, wherein said coaxial connector includes an insulated connector housing; an outer connector conductor provided outside the insulated connector housing and capable of connecting to an outer conductor of the coaxial cable; and a contact provided in the insulated connector housing to be movable and capable of connecting to a center conductor of the coaxial cable, said contact having distal end portion protruding outside the insulated connector housing before the coaxial connector is attached to the coaxial change-over switch, and said coaxial change-over switch includes an insulated switch housing having an insertion hole for receiving the contact; an outer switch conductor provided outside the insulated switch housing; and a first contact arm and a second contact arm provided inside the insulated switch housing for contacting to and separating from each other so that the distal end portion pushes the first contact arm away from the second contact arm when the coaxial connector is attached to the coaxial change-over switch.

* * * * *